US005413356A

United States Patent [19]

Bigelow

[11] Patent Number: 5,413,356

[45] **Date of Patent: * May 9, 1995**

[54] SET UP METHOD FOR A SOCCER NET

[76] Inventor: Robert Bigelow, 2511 Poppy St., East Meadow, N.Y. 11554

[ * ] Notice: The portion of the term of this patent subsequent to May 3, 2011 has been disclaimed.

[21] Appl. No.: 205,805

[22] Filed: Mar. 4, 1994

[51] Int. Cl.[6] ..... A63B 63/04

[52] U.S. Cl. ..... 273/400

[58] Field of Search ..... 273/398, 400, 401, 402, 273/411, 127 R

[56] References Cited

U.S. PATENT DOCUMENTS

| | | | |
|---|---|---|---|
| 5,186,469 | 2/1993 | Terris | 273/400 |
| 5,244,213 | 9/1993 | Armell | 273/400 |
| 5,273,292 | 12/1993 | Pardi et al. | 273/400 |
| 5,308,082 | 5/1994 | Bigelow | 273/400 |

*Primary Examiner*—Raleigh W. Chiu

[57] ABSTRACT

A two frame enclosure serving as a compartment for a soccer net stored therebetween which unlocks from the rear of the goal and is lowered onto ground level behind the goal and only one frame is then raised with the attached net into position against the goal which simultaneously unfolds the net and stretches it open against the weight of the stationary frame into its goal-tending condition behind the goal.

1 Claim, 3 Drawing Sheets

SET UP METHOD FOR A SOCCER NET

The present invention relates generally to improvements for handling a soccer net, and more particularly to facilitated after-game storage and pre-game setup of the net.

EXAMPLE OF THE PRIOR ART

It is already well known as illustrated and described in U.S. Pat. No. 5,186,469 issued to George Terris on Feb. 16, 1993 to improve the handling of a soccer net by the use of a folding support frame to provide an open erect game-use net condition and, when the frame is folded closed, a compact storage condition of the net. It is still necessary, however, after a game to remove the net and frame to a location secured against vandalism and the like, and prior to a game to transport the net and frame to its playing field location.

Broadly, it is an object of the present invention to provide for the handling of a soccer net improvements overcoming the foregoing and other shortcomings of the prior art. More particularly, it is an object to use to advantage the support of the goal post to safely store and readily place the net in goal-tending condition.

The description of the invention which follows, together with the accompanying drawings, should not be construed as limiting the invention to the example shown and described, because those skilled in the art to which this invention appertains will be able to devise other forms thereof within the ambit of the appended claims.

It should be readily appreciated that a goal-attached soccer net left unattended is vulnerable to weather damage and vandalism. However, to obviate this by removing the soccer net between games and restoring its game position at game time is time consuming and tedious. It is thus significant that, in accordance with the present invention, the soccer net is provided with safe, out-of-sight storage at the goal site, and sets up in a facilitated manner to function as intended at game time.

Figure 1:
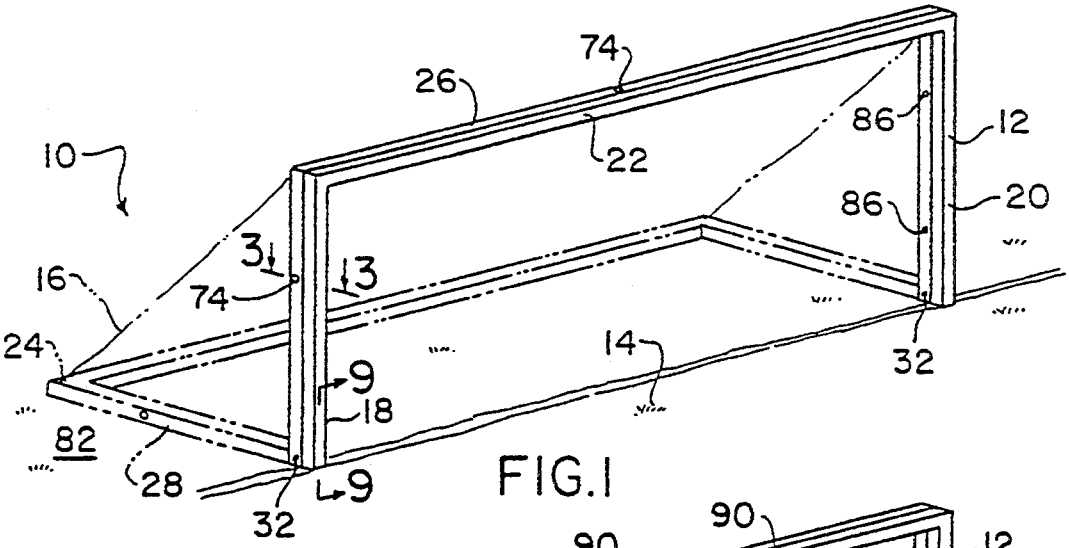
FIG. 1 is a perspective view of a soccer goal preparatory to a soccer game and depicts at this time in full line the storage of the soccer net, and in phantom line perspective depicts what is typically the game position of the soccer net.
Figure 5:
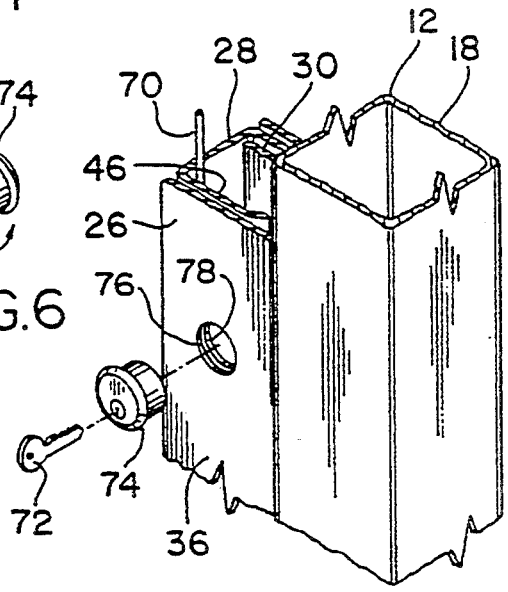

It will subsequently be explained in detail, but preliminarily assume the arriving game participants find goal 12 at its field site 14 with the soccer net in storage and initially out-of-sight as depicted in FIG. 1. Designated individuals will follow a net setup procedure, commenced by using keys 72 (FIG. 5) to unlock and remove plug type locks 74, at least one of which lock 74 is used to project through aligned openings 76 and 78 respectively in panel 36 of housing component 26 and panel 46 of housing component 28. Thusly unlocked, housing 28 conveniently engaged at a finger grip opening 50 (FIG. 7) is urged through a pivotal traverse in the direction of arrow 80 of FIG. 2 carrying with it housing 30, the peripheral edge of soccer net 16 being secured between the housings 30 and 28 along the U-shaped peripheral edges of these housings.

Figure 2:
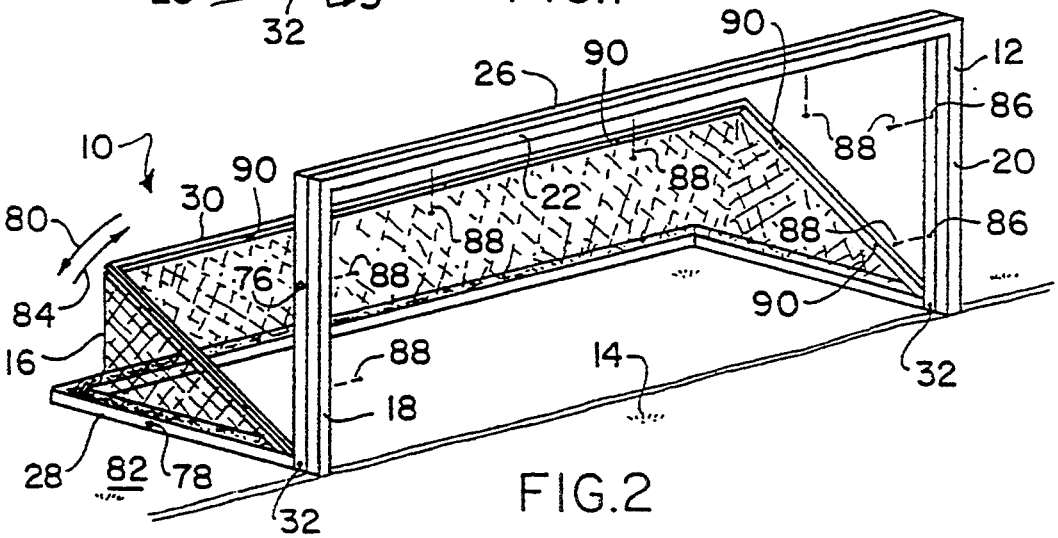
FIG. 2 is the same perspective view as FIG. 1, but illustrating how the soccer net is urged through movements between its storage and game positions.

Laid to rest on the ground 82, as shown in FIG. 2, housing 28 is left in this position and, after preparation subsequently to be noted, housing 30 is raised in the direction of arrow 84 into engagement with goal 12 established by pins 88, thereby opening soccer net 16 for game goal-tending service.

Still referring to FIG. 2, it should be noted that use of the cooperating housings or frames, namely frame 30 which in relation to the goal 12 occupies an "inner" position and frame 28 an "outer" position, results in a noteworthy and greatly facilitated method of setting up the soccer net 16 in its game condition. That is, goal 12 is already in a vertically erect condition at the location 14 on the playing field at which the net 16 has to be set up, and in the set up method is advantageously used to support the net in an unfolded and open condition (as shown in phantom in FIG. 1) to limit travel, and thus obviate the need to retrieve a soccer ball scoring a goal that is kicked through the opening bounded by the side posts 18, 20 and top post 22. To this end, the soccer net 16, in a folded condition, has an upper peripheral length portion at 90 connected to the inner frame 30 and a lower peripheral length portion connected to the outer frame 28, both frames 28, 30 being disposed at ground level behind the goal 12. From this initial condition, only inner frame 30 is raised through a pivotal traverse 84 into a supported position onto the goal 12, and a consequence of this pivotal traverse the soccer net 16 is simultaneously unfolded and stretched open against the weight of the stationary outer frame 28 to assume its goal-tending position behind and in rearward alignment with the opening of the goal 12.

After the game, the procedure is reversed to provide for safe storage under lock and key of the soccer net 16. Pins 88 are removed from openings 86 and housing 30 lowered in the direction of arrow 80, as shown in FIG. 2, into the ground level housing 28, and this results in an adjacent position of the peripheral net edges 90 and, thus, the bunching of the net in a folded condition within the two housings 28, 30. Flaps 56 attached at 58 are then closed over the net 16 (not shown in FIG. 8) and held in place by VELCRO patches 60, 62.

Figure 6:
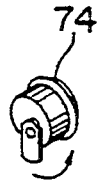
FIG. 6 is an isolated view of lock 74 as seen from the reverse side at which it is depicted in FIG. 5.

The soccer net 16 in its storage position within the compartment bounded between the housings 26, 28 is then raised in the arrow direction 84 to a position within the confines of side panels 36 and 38 of a stationary housing 26 extending rearwardly of the left, right and crosspiece posts 18, 20 and 22, respectively, of the soccer goal 12. A key-operated lock 74 is then replaced through the aligned housing openings 76 and 78 and the locking lug thereof turned as noted in FIG. 6 to complete the safe storage system 10 of the soccer net 16 at the site 14 of the soccer goal 12.

While the within inventive improvements for storing and using the soccer net 16 should be readily understood from the preceding description, for completeness' sake, structural details only alluded to will now be described in detail. Goal 12, as generally understood, is of tubing of metal construction material permanently anchored centrally at each opposite end line of the playing field for field hockey, lacrosse and, specifically in this instance, soccer. Prior art practice contemplated staking or pegging the net bottom edge 24 to the turf 82 behind the goal 12, a practice obviated by the within net storage and setup system 10.

Figure 3:
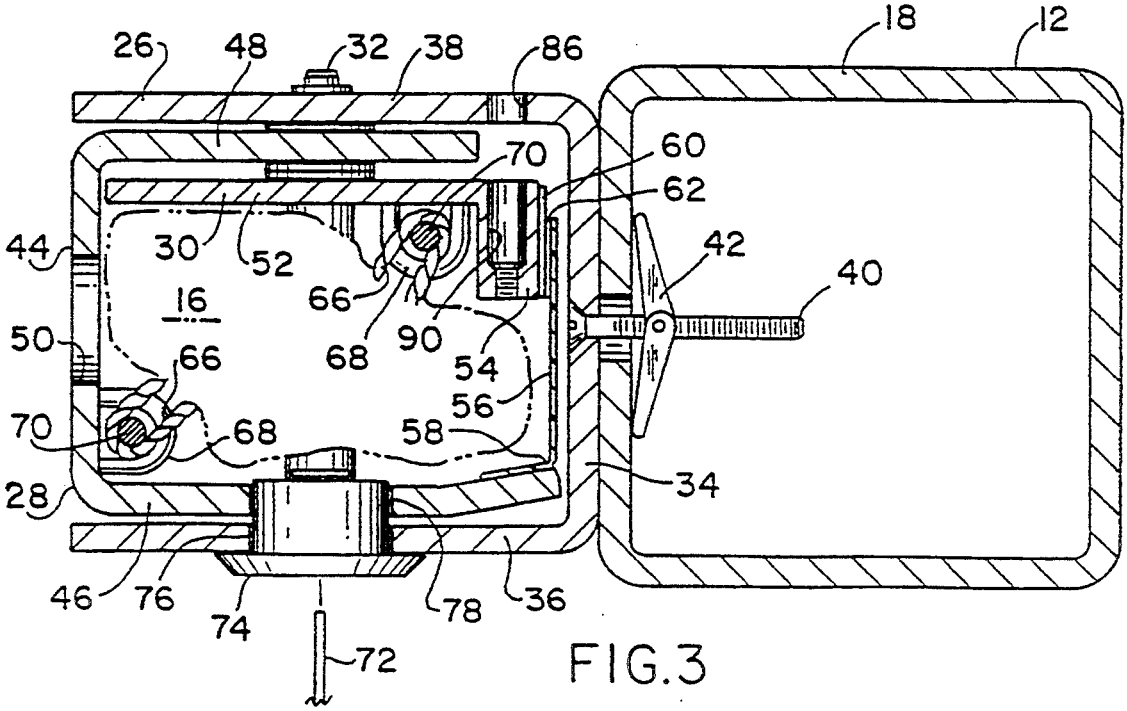
FIG. 3 is an enlarged scale sectional view taken along line 3—3 of FIG. 1 illustrating cooperating positions of components providing the storage position of the soccer net.
Figure 7:
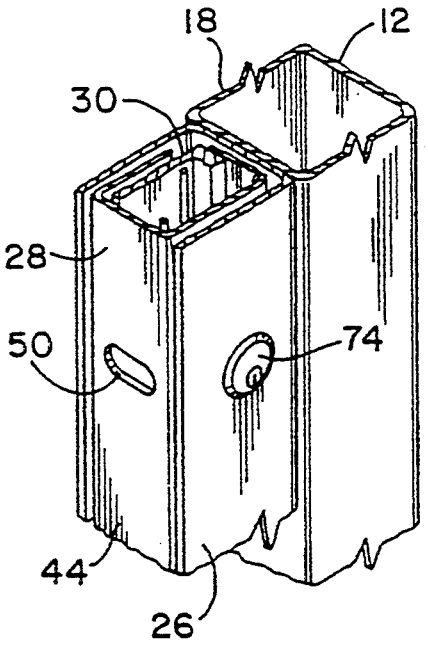
FIGS. 5 and 7 are partial perspective views of components as seen from slightly different angles, focusing on the lock 74 provided for security.

The system 10 is comprised of the use of three principal members, namely a fixed housing 26, a net-holding grounded housing 28 and a net-positioning housing 30. The pivotal traverses of housings 28 and 30 are about a pivot 32 in the bottom of the fixed or stationary housing 26, which housing, as best seen in FIG. 3, is U-shaped in cross section formed by side panels 36 and 38 and a connecting panel 34, the latter secured to goal 12 by bolts 40 and butterfly nuts 42. Similarly, housing 28 is U-shaped with side panels 46 and 48 and a connecting panel 44 provided for convenient gripping with finger holes 50 (FIG. 7). Housing 28 is sized to fit within housing 26.

Figure 8:
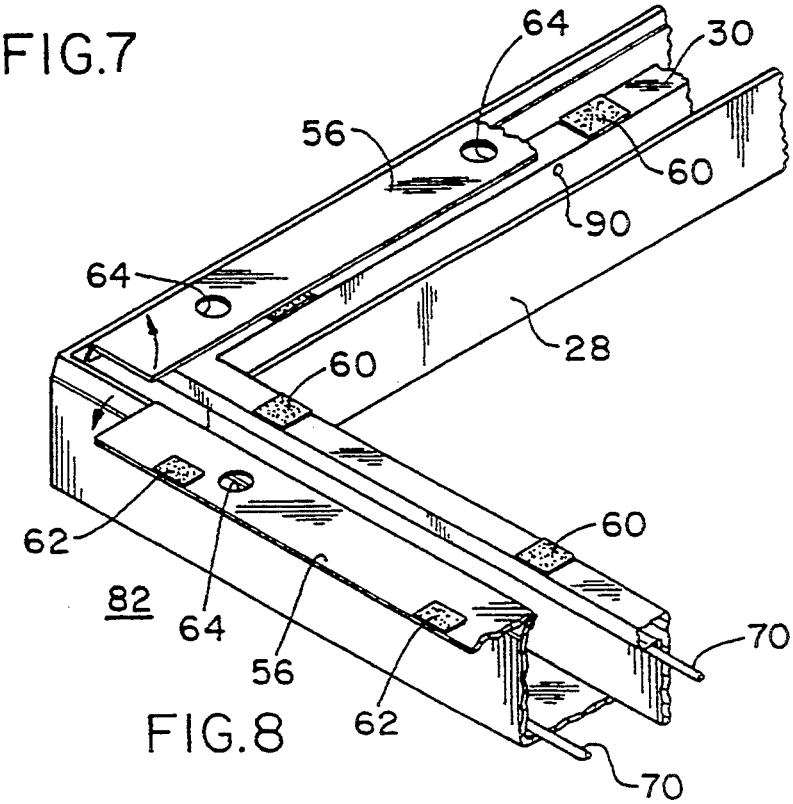
FIG. 8 is a partial perspective view of the soccer net storage components.

The housing movement which positions the net 16 is the pivotally mounted L-shaped housing 30 formed of a flat panel or wall 52 and an inturned flange 54. Flaps 56 on the panel 46 of housing 28 are provided with VELCRO patches 62 cooperating with VELCRO patches 60 on the flange 54, these flaps also being provided for convenient gripping with finger holes 64 (FIG. 8).

Figure 4:
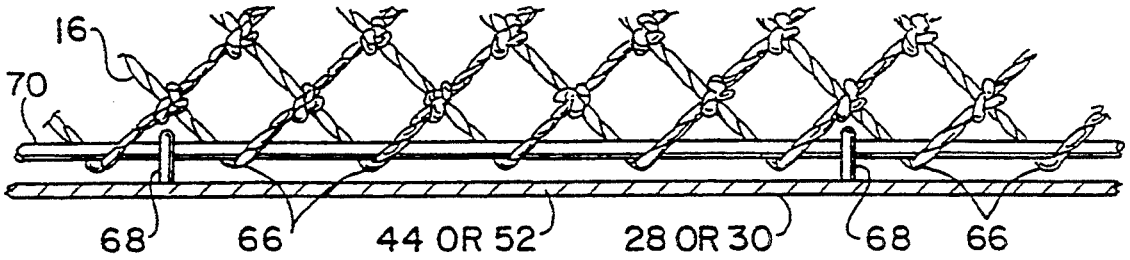
FIG. 4 is an isolated partial view illustrating how the soccer net's peripheral edge attachment to components is achieved.

To attach the net to the components, loops 66 along the edge of the net are connected to the housings 28 and 30 utilizing a series of eyelets 68 that cooperate with housing-attached rods 70, as best shown in FIG. 4.

Figure 9:
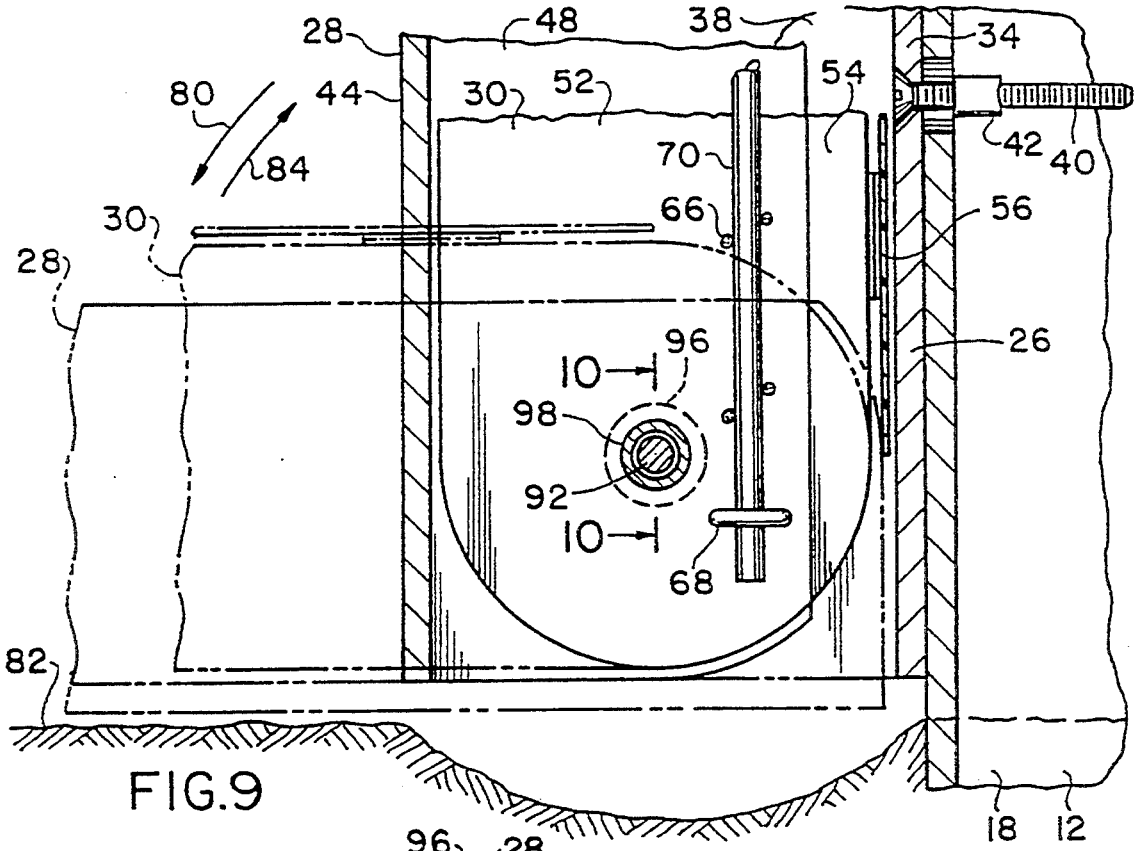
FIG. 9 is a partial cross sectional view taken along line 9—9 of FIG. 1 supplementing the structural details illustrated in FIG. 3, and focusing on positions of movement of component 30.
Figure 10:
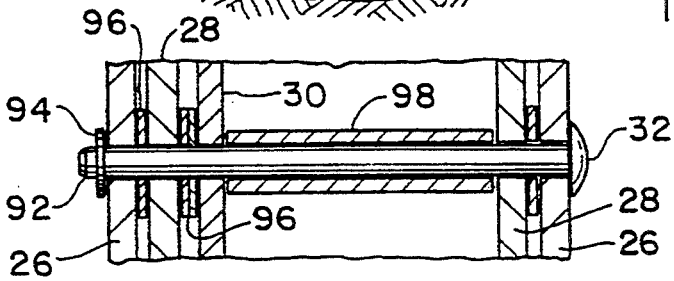
FIG. 10 is an isolated view of a pivot 32 allowing the movement positions of FIG. 9, in section taken along line 10—10 of FIG. 9.
Figure 11:
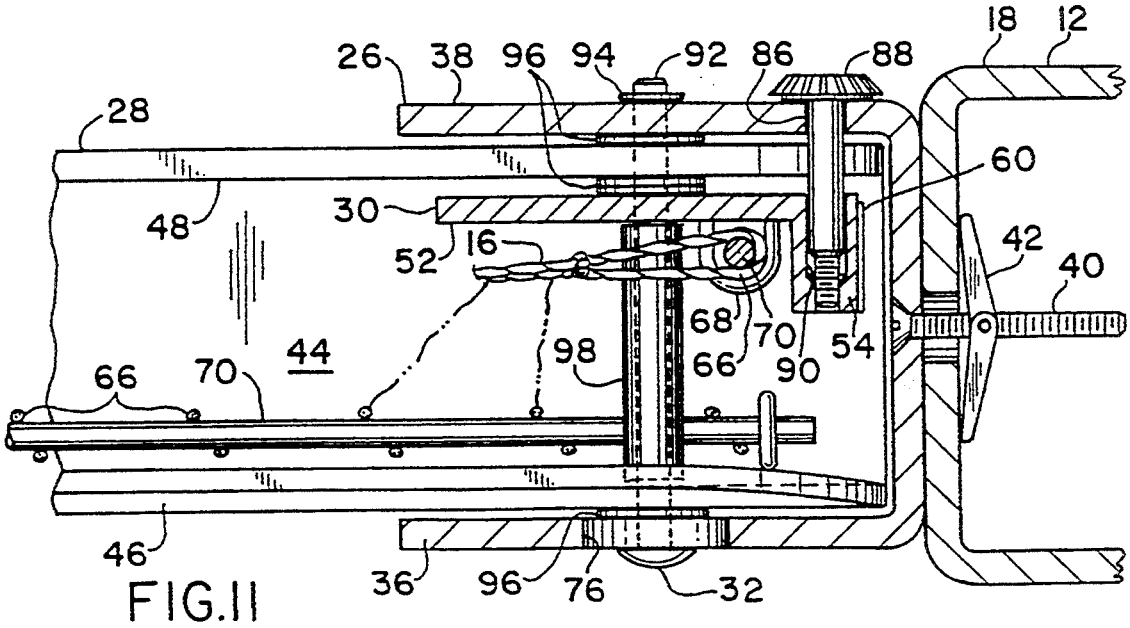
FIG. 11 is a similar view to FIG. 3, but of the game position of the soccer net as illustrated in phantom perspective in FIG. 1.

The degree of pivotal movement in the housings 28, 30 is about a pivot 32, as best shown in FIGS. 9 and 10, consisting of a pin 92 and projected through a spacer sleeve 98 and held in place by a C-ring 94. Washers 96 complete the spacing of the housings 26 and 28.

While the soccer net set up method herein shown and disclosed in detail is fully capable of attaining the objects and providing the advantages hereinbefore stated, it is to be understood that it is merely illustrative of the within inventive method, and that no limitations are intended thereto other than as defined in the appended claim.

What is claimed is:

1. A method of setting up a soccer net for a soccer game comprising the steps of providing as support for said soccer net a goal having an opening bounded by vertically oriented opposite side posts and a horizontally oriented top post connected in spanning relation therebetween, placing in facing relation an inner and outer cooperating pair of U-shaped frames disposed at ground level behind said goal, connecting a folded soccer net having a peripheral edge in between said frames with an upper peripheral length portion being connected to said inner frame and a lower peripheral length portion being connected to said outer frame, and raising only said inner frame into a supported position onto said goal, whereby said soccer net is simultaneously unfolded and stretched open against the weight of the stationary outer frame to thereby provide goal-tending service behind said goal.

* * * * *